United States Patent [19]

Melton

[11] Patent Number: 4,533,411

[45] Date of Patent: Aug. 6, 1985

[54] METHOD OF PROCESSING NICKEL-TITANIUM-BASE SHAPE-MEMORY ALLOYS AND STRUCTURE

[75] Inventor: Keith N. Melton, Cupertino, Calif.

[73] Assignee: Raychem Corporation, Menlo Park, Calif.

[21] Appl. No.: 553,005

[22] Filed: Nov. 15, 1983

[51] Int. Cl.[3] ..... C22F 1/10; C22F 1/18

[52] U.S. Cl. ..... 148/402; 148/11.5 F; 148/11.5 M; 148/12.7 B

[58] Field of Search ..... 148/11.5 R, 11.5 F, 148/11.5 C, 11.5 N, 12.7 B, 12.7 R, 402; 420/587

[56] References Cited

U.S. PATENT DOCUMENTS

| | | | |
|---|---|---|---|
| 4,067,752 | 1/1978 | Brook et al. | 148/11.5 R |
| 4,144,057 | 3/1979 | Melton et al. | 148/11.5 R |
| 4,149,911 | 4/1979 | Clabburn | 148/11.5 C |
| 4,198,081 | 4/1980 | Harrison et al. | 148/402 |
| 4,337,090 | 6/1982 | Harrison | 148/402 |

FOREIGN PATENT DOCUMENTS

| | | | |
|---|---|---|---|
| 35069 | 9/1981 | European Pat. Off. | 148/402 |
| 157935 | 9/1983 | Japan | 420/587 |
| 161753 | 9/1983 | Japan | 148/402 |

OTHER PUBLICATIONS

Wayman, "Some Applications of Shape Memory Alloys", Journal of Metals, Jun. 1980, pp. 129–137.

*Primary Examiner*—Peter K. Skiff

*Attorney, Agent, or Firm*—Ira D. Blecker; James W. Peterson

[57] ABSTRACT

Method of processing nickel-titanium-base shape-memory alloys to substantially suppress the two-way effect including the steps of cold working and low-temperature annealing without restraint. A composite structure is also provided including a nickel-titanium-base shape-memory alloy with the two-way effect substantially suppressed.

11 Claims, No Drawings

METHOD OF PROCESSING NICKEL-TITANIUM-BASE SHAPE-MEMORY ALLOYS AND STRUCTURE

BACKGROUND OF THE INVENTION

1. Field of the Invention

This invention relates to a method of processing nickel-titanium-base shape-memory alloys to substantially suppress the two-way effect and to a composite structure including a nickel-titanium-base shape-memory alloy with the two-way effect substantially suppressed.

2. Discussion of the Prior Art

Materials, both organic and metallic, capable of possessing shape memory are well known. An article made of such materials can be deformed from an original, heat-stable configuration to a second, heat-unstable configuration. The article is said to have shape memory for the reason that, upon the application of heat alone, it can be caused to revert or attempt to revert from its heat-unstable configuration to its original, heat-stable configuration, i.e., it "remembers" its original shape.

Among metallic alloys the ability to possess shape memory is a result of the fact that the alloy undergoes a reversible transformation from an austenitic state to a martensitic state with a change of temperature. Also, the alloy is considerably stronger in its austenitic state than in its martensitic state. This transformation is sometimes referred to as a thermoelastic martensitic transformation. An article made from such an alloy, for example, a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete), the deformed object will begin to return to its original configuration.

Alloys of nickel and titanium have been demonstrated to have shape-memory properties which render them highly useful in a variety of applications.

Shape-memory alloys (SMAs) have found use in recent years in, for example, pipe couplings (such as are described in U.S. Pat. Nos. 4,035,007 and 4,198,081 to Harrison and Jervis), electrical connectors (such as are described in U.S. Pat. No. 3,740,839 to Otte & Fischer), switches (such as are described in U.S. Pat. No. 4,205,293), actuators, etc., the disclosures of which are incorporated hereby by reference.

Various proposals have also been made to employ shape-memory alloys in the medical field. For example, U.S. Pat. No. 3,620,212 to Fannon et al. proposes the use of an SMA intrauterine contraceptive device, U.S. Pat. No. 3,786,806 to Johnson et al. proposes the use of an SMA bone plate, U.S. Pat. No. 3,890,977 to Wilson proposes the use of an SMA element to bend a catheter or cannula, etc., the disclosures of which are incorporated herein by reference.

These medical SMA devices rely on the property of shape memory to achieve their desired effects. That is to say, they rely on the fact that when an SMA element is cooled to its martensitic state and is subsequently deformed, it will retain its new shape; but when it is warmed to its austenitic state, the original shape will be recovered.

The shape change occurring suddenly and only through the influence of temperature is described as the one-way effect because the shape prior to raising the temperature is not regained upon subsequently decreasing the temperature but must first be reformed mechanically. In some cases, however, upon subsequent thermal cycling a purely thermally-dependent shape reversibility is observed which is described as the two-way effect. In applications such as thermoelectric switches, for example as described in U.S. Pat. No. 4,205,293, the two-way effect is useful. In other applications, however, it is desired to suppress the two-way effect, for example, in couplings. Thus, on heating and making a coupling with an alloy whose transformation temperature is above room temperature, the two-way effect causes the coupling to become loose on cooling back to room temperature.

Clearly, therefore, it is desirable to develop processing which will substantially suppress the two-way effect in nickel-titanium-base shape-memory alloys.

Methods of achieving cyclic stability are known in the art, as from U.S. Pat. Nos. 3,948,688, 3,652,969 and 3,953,253. However, these patents suffer from the disadvantage that thermal cycling under load of the component is required and they do not suppress the two-way effect. Also, it is desirable to achieve cyclic stability in a method that can be applied to the semi-finished product, for example, bar, wire or sheet, during the normal.-manufacturing procedure and thereby provide significant cost savings.

U.S. Pat. No. 4,283,233 describes a process for varying the shape change temperature range (TTR) of Nitinol (nickel-titanium based) alloys by selecting the final annealing conditions. Prior to the annealing step the alloy is cold worked to bring it to a convenient size and shape and to remove any prior shape-memory effect which may be present in the alloy. The material is then formed into its permanent shape, restrained in this permanent shape and annealed under restraint. This procedure does not substantially suppress the two-way effect.

It is known that cold work can impart interesting effects to nickel-titanium-base alloys (for example, see T. Tadaki and C. M. Wayman, Scripta Metall., Vol. 14, P. 911, 1980), and the stress-strain curves at room temperature after cold work the annealing at temperatures between 300° C. and 950° C. have been reported; see O. Mercier and E. Torök, International Conference on Martensitic Transformations (ICOMAT), Leuven, 1982, P. C4-267. Also, work by Otsuka, for example, S. Miyazaki, Y. Ohmi, K. Otsuka and Y. Susuki, ICOMAT, Leuven, 1982, P. C4-255 and K. Otsuka and K. Shimizu, International Summer Course on Martensitic Transformations, Leuven, 1982, has shown that pseudoelstic effects are improved by cold working followed by annealing at 300° C.

It is therefore highly desirable to develop a method of processing nickel-titanium-base shape-memory alloys to substantially suppress the two-way effect and a composite structure including a nickel-titanium-base shape-memory alloy with the two-way effect substantially suppressed.

DESCRIPTION OF THE INVENTION

Summary of the Invention

I have discovered a method of processing nickel-titanium-base shape-memory alloys to substantially suppress the two-way effect. The method of the present invention comprises: providing a nickel-titanium-base shape-memory alloy in the austenitic state in a specified shape, as by hot working; cold working said alloy in the martensitic state from 15% to 40% to provide a microstructure containing a high concentration of substantially random dislocations; annealing said alloy without restraint at 300° C. to 500° C. for at least 20 minutes and preferably for 20 to 90 minutes to rearrange the dislocations into an ordered network of dislocations comprising essentially dislocation-free cells surrounded by walls of higher dislocation density and to provide said alloy in a desired shape; deforming the alloy in the martensitic state; and heating said alloy to the austenitic state to recover and substantially retain said desired shape. When the alloy is subsequently cooled to the martensitic state it substantially retains said desired shape. The alloy should be annealed at a temperature higher than the temperature at which the alloy is fully pseudoelastic, generally in excess of 125° C.

Pseudoelasticity is the phenomenon whereby large nonproportional strains can be obtained on loading and unloading certain alloys. The alloys show a reversible martensitic transformation and are deformed in the austenitic condition at a temperature where martensite is thermally unstable. On deformation when a critical stress is exceeded a stress-induced martensitic forms resulting in several percent strain. In the absence of stress, however, the martensite reverts back to austenite, i.e. on unloading below a second critical stress, the reverse transformation occurs and the strain is completely recovered. The critical stress to nucleate a stress-induced martensite depends on the temperature. Increasing the temperature above that at which martensite would form at zero stress requires an increasing stress to induce martensite. However, once this stress exceeds that at which normal irreversible plastic flow occurs, then this prevents complete recovery on unloading. The minimum temperature at which a coupling should be recovered is thus the temperature at which the stress to nucleate martensite and the stress to cause normal plastic flow are equal.

Surprisingly, it has been found that the process of the present invention substantially suppresses the two-way effect. Thus, on heating and making a coupling with an alloy whose transformation temperature is above room temperature, the two-way effect normally present causes the coupling to become loose on cooling back to room temperature. However, material processed in accordance with the present invention provided "heat-to-shrink" couplings which did not open even on cooling back down to the martensitic condition.

In addition to the foregoing, the process of the present invention obtains additional advantages. Thus, the yield strength of the austenite phase is increased by a factor of up to three while surprisingly the yield strength of the martensitic phase remains essentially constant. Also, cyclic stability is improved, i.e., the dimensional changes occurring during thermal cycling under load are minimized.

I have also discovered a composite structure which comprises a first and a second member in contacting relationship therewith, wherein said second member is a nickel-titanium-base shape-memory alloy exhibiting the two-way effect, with said second member firmly contacting said first member when said second member is in the austenitic state, wherein said second member is at least partially transformed to the martensitic state.

Detailed Description of the Preferred Embodiments

The present invention may suitably apply to any nickel-titanium-base shape-memory alloy such as those referred to in the patents discussed hereinabove. Naturally, the nickel-titanium-base alloy may contain one or more additives in order to achieve particularly desirable results, such as, for example, nickel-titanium alloys containing small amounts of copper, iron or other desirable additives. Similarly, the nickel-titanium-base shape-memory alloys processed in accordance with the present invention may be conveniently produced in a form for processing in accordance with the present invention by conventional methods as also described in the patents referred to hereinabove, such as, for example, by electronbeam melting or arc-melting in an inert atmosphere.

In accordance with the method of the present invention the nickel-titanium-base shape-memory alloy is provided in the austenitic state in a specified shape, for example, a bar of said alloy can be readily prepared by conventional melting and casting techniques and the resulting ingot hot-swaged to a specified shape. The alloy is then cold worked, for example, by cold swaging, in an amount from 15% to 40%. The cold-working step imparts conventional plastic flow to the material and provides a microstructure containing a high concentration of substantially random dislocations. This is followed by a low-temperature annealing step without restraint at a temperature of 300° C. to 500° C. for at least 20 minutes and preferably no more than 90 minutes to rearrange the dislocations into an ordered network of dislocations comprising essentially dislocation-free cells surrounded by walls of higher dislocation density and to provide said alloy in a desired shape. It has been found that temperatures below 300° C. do not rearrange the dislocations, and temperatures above 500° C. result in disappearance of dislocations. If necessary, the resultant material may then be transformed into its final configuration, as by stamping or machining, for example, the bar resulting from the annealing step may be machined into an annular hollow ring. Also, a further low-temperature anneal, for example, from 300° C. to 400° C. for from 15 minutes to one hour, may be applied to relieve any internal stresses resulting from the machining operation.

The material is then deformed in the martensitic state, as for example expanding the ring less than 8% so that the desired shape is heat-recoverable, followed by heating the alloy to the austenitic state to recover the desired shape and to substantially retain said desired shape. It is a finding of the present invention that when the alloy is subsequently cooled to the martensitic state the material substantially retains said desired shape, i.e., the two-way effect is substantially suppressed. In the preferred embodiment the alloy is annealed at a temperature higher than the temperature at which the alloy is fully pseudoelastic, generally in excess of 125° C.

Thus, for example, in accordance with the method of the present invention the coupling remains tightly secured after the material is subsequently cooled to the martensitic state.

The method and composite structure of the present invention and improvements resulting therefrom will be more readily apparent from a consideration of the following exemplificative examples.

EXAMPLE I

A bar of a nickel-titanium alloy having a composition of about 50 atomic percent nickel and about 50 atomic percent titanium was prepared by conventional melting and casting techniques and the resulting ingot hot-swaged at 850° C. This bar was then cold-swaged to a 20% area reduction resulting in a microstructure containing a high concentration of substantially random dislocations. The bar was then annealed for 60 minutes at 400° C. This low-temperature annealing step resulted in a rearrangement of the dislocations into an ordered network of dislocations comprising essentially dislocation-free cells surrounded by walls of higher dislocation density and also provided said alloy in its desired shape. A hollow ring of inside diameter (ID) of 0.240", outside diameter (OD) of 0.33" and length of 0.25" was then machined from the annealed bar and the ring itself subsequently annealed for 30 minutes at 350° C. to relieve any internal stresses resulting from the machining operation. The ring was then expanded at 0° C. by pushing a mandrel through the ring. The ring was cooled to 0° C. in order to prevent the heat of deformation causing an in situ shape-memory effect. An expansion of 7% (after elastic springback) calculated on the ID was used with a mandrel having a maximum OD of 0.26".

The expanded ring was stored at room temperature. A length of nominal 0.25" OD stainless steel tubing was inserted into the ring at room temperature and the ring heated to a temperature of around 200° C. after which it shrunk tightly onto the stainless steel tubing. The assembly was then cooled down to −30° C. using a freon spray and the ring again remained tightly in place. This clearly demonstrated that the two-way effect had been effectively suppressed in accordance with the method of the present invention and the ring remained tight even in its martensitic state.

In a further test, the assembly was heated to 100° C. rather than 200° C. set out hereinabove. This was sufficient to cause the ring to shrink onto the stainless steel tubing; however, on subsequent cooling to room temperature, the ring became loose. At 100° C., strips of the alloy processed in the same manner as indicated hereinabove, i.e., cold-rolled 20% followed by annealing for 60 minutes at 400° C., were fully pseudoelastic when tested in a tensile test. That is, 6% of strain was fully recovered on unloading. This clearly indicates that 100° C. is sufficiently high with respect to the transformation from austenite to martensite, but that the transformation is fully reversible on unloading. However, it was discovered that heating to higher temperatures, for example, in excess of 125° C., where full pseudoelastic recovery was not observed in a tensile test, resulted in the ring remaining tight at room temperature. Thus, the installation of a ring or coupling which must remain tight on subsequent cooling to martensite and with respect to which the two-way effect is unexpectedly suppressed requires heating to a temperature higher than the temperature at which the alloy is fully pseudoelastic.

EXAMPLE II

A hot-worked bar of a nickel-titanium alloy containing 48 atomic percent nickel, 46 atomic percent titanium and 6 atomic percent vanadium was prepared in a manner after Example I. The bar was cold-swaged to 20% area reduction with care being taken to prevent the bar from becoming too hot since in situ shape-memory during swaging can cause cracking. The microstructure of the resultant material contained a high concentration of substantially random dislocations. After cold work the bar was annealed for 60 minutes at 450° C. resulting in a microstructure similar to that set out in Example I after the low-temperature annealing step and a hollow ring of the dimensions set forth in Example I prepared therefrom by machining. After machining, the ring was annealed for 30 minutes at 400° C. and the ring expanded as in Example I at a temperature of around 0° C.

The expanded ring was put over a stainless steel tubing having an OD of 0.25" and the assembly heated to around 200° C. This caused the ring to go through its memory transition and shrink down tightly onto the tube. On cooling back to room temperature where the alloy was at least partly in its martensitic state, an axial force of 282 pounds was required to start the ring moving. Further motion then occurred at a force of 150 pounds. This clearly demonstrated that the two-way effect was substantially suppressed in accordance with the method of the present invention.

EXAMPLE III

A coupling member was machined from the cold-worked bar stock prepared as in Example II. The member was 0.65" long with an OD of 0.5" and was provided on its inner surface with four (4) teeth in the form of radially extending rings as described in U.S. Pat. No. 4,226,448. The minimum ID at the teeth was 0.24". The coupling member was expanded at 0° C. using a mandrel with the expansion being about 7% after springback. Two stainless steel tubes of 0.25" OD were inserted into the expanded coupling member which had been allowed to warm up to room temperature. The insertion was done such that two of the teeth rings were around each of the tubes. The coupling member was then heated to around 180° C. whereupon it shrunk tightly down onto the tubes to provide a tight connection. On cooling to room temperature, the coupling remained tight and in a pressure test to 600 psi no leak could be detected. The leak detection was done by immersing the pressurized coupling in water and looking for escaping air bubbles. None could be found.

EXAMPLE IV

The cold-worked bar of the alloy of Example I prepared substantially as in Example I was annealed for 30 minutes at 850° C. and slowly cooled. A ring of the same dimensions as described in Example I was machined from the bar, stress relieved at 350° C. and then expanded 7% at 0° C. and allowed to warm up to room temperature. A piece of 0.25" OD stainless steel tube was inserted in the ring and the ring heated to about 200° C. whereupon it shrunk tightly down onto the ring. However, on subsequent cooling to room temperature, the ring did not remain tight. A noticeable loosening occurred and the ring could be easily rotated by hand, clearly indicating that the two-way effect had taken place. Thus, conventionally soft annealed material cannot be used in its martensitic condition as a coupling member since the occurrence of a two-way effect loosens the ring.

EXAMPLE V

A wire of a nickel-titanium alloy having a composition of about 50 atomic percent nickel and 50 atomic percent titanium was cold-drawn 16% at room temperature to produce a final wire diameter of 0.04". This was then wrapped around pins to form loops of various curvatures and the ends of the wires were clamped. The resultant assembly was anealed under constraint, after which the assembly was cooled to room temperature and the constraint removed. The latter operation was done carefully so as to prevent accidental deformation of the wire. On subsequent heating to 100° C., a small shape-memory effect occurred. This was repeatable, i.e. after cooling to room temperature a reverse motion was observed and on reheating the same shape-memory effect was found. Heating to about 200° C. did not diminish the magnitude of the shape memory, i.e. the two-way effect could not be suppressed by heating beyond the pseudoelastic range. This clearly shows that constrained aging does not suppress the two-way effect.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

I claim:

1. A method of processing nickel-titanium-base shape-memory alloys to substantially suppress the two-way effect which comprises:

providing a nickel-titanium-based shape-memory alloy in the austenitic state in a specified shape;

cold working said alloy in the martensitic state from 15% to 40% to provide a microstructure containing a high concentration of substantially random dislocations;

annealing said alloy without restraint at 300° C. to 500° C. for at least 20 minutes to rearrange the dislocations into an ordered network of dislocations comprising essentially dislocation-free cells surrounded by walls of higher dislocation density;

providing said alloy in a desired shape while maintaining the dislocation-free cells obtained in the annealing step; and deforming the alloy in the martensitic state; whereby when the alloy is recovered by heating the alloy to the austenitic state and subsequently cooled to the martensitic state, the alloy substantially retains said desired shape.

2. A method according to claim 1 wherein after the step of deforming the alloy, the method further comprises heating said alloy to the austenitic state to recover and substantially retain said desired shape.

3. A method according to claim 1 wherein said alloy is annealed for from 20 to 90 minutes.

4. A method according to claim 2 wherein the alloy is subsequently cooled to the martensitic state and substantially retains said desired shape.

5. A method according to claim 2 wherein the step of heating said alloy is at a temperature higher than the temperature at which the alloy is fully pseudoelastic.

6. A method according to claim 5 wherein said heating temperature is in excess of 125° C.

7. A method according to claim 1 wherein the alloy is hot worked in the austenitic state to provide said alloy in a specified shape.

8. A method according to claim 1 wherein said desired shape is machined or stamped after annealing and before deforming.

9. A coupling member produced by the process of processing nickel-titanium-base shape-memory alloys to substantially suppress the two-way effect which comprises:

providing a nickel-titanium-base shape-memory alloy in the austenitic state in a specified shape;

cold working said alloy in the martensitic state from 15% to 40% to provide a microstructure containing a high concentration of substantially random dislocations;

annealing said alloy without restrain at 300° C. to 500° C. for at least 20 minutes to rearrange the dislocations into an ordered network of dislocations comprising essentially dislocation-free cells surrounded by walls of higher dislocation density and to provide said alloy in a desired shape; and deforming the alloy in the martensitic state; whereby when the alloy is recovered by heating the alloy to the austenitic state and subsequently cooled to the martensitic state, the alloy will revert to the martensitic state without exhibiting the two-way effect.

10. The coupling member produced by the process according to claim 9 wherein after the step of deforming the alloy, the process further comprises heating said alloy to the austenitic state to recover and substantially retain said desired shape.

11. The coupling member produced by the process according to claim 10 wherein the alloy is subsequently cooled to the martensitic state and substantially retains said desired shape.

* * * * *